US005542771A

United States Patent [19]

Masumoto

[11] Patent Number: 5,542,771

[45] Date of Patent: Aug. 6, 1996

[54] APPLICATOR HAVING CAP WHICH PRESSURIZES AND SEALS INNER SPACE

[75] Inventor: Yasuhiro Masumoto, Tokyo, Japan

[73] Assignee: Sailor Pen Co., Ltd., Tokyo, Japan

[21] Appl. No.: 317,231

[22] Filed: Oct. 3, 1994

[51] Int. Cl.[6] ..... B43K 9/00; B43K 7/00

[52] U.S. Cl. ..... 401/213; 401/187; 401/188 A; 401/214

[58] Field of Search ..... 401/213, 214, 401/188 A

[56] References Cited

U.S. PATENT DOCUMENTS

| | | | |
|---|---|---|---|
| 1,848,358 | 3/1932 | Kratz . | |
| 4,086,011 | 4/1978 | Kuparinen . | |
| 4,334,622 | 5/1982 | Mutschler . | |
| 5,154,526 | 10/1992 | Bothe . | |
| 5,362,169 | 11/1994 | Hamamoto et al. . | |
| 5,462,379 | 10/1995 | Masumoto et al. | 401/213 |

FOREIGN PATENT DOCUMENTS

| | | | |
|---|---|---|---|
| 817414 | 10/1951 | Germany | 401/213 |
| 817415 | 10/1951 | Germany | 401/213 |
| 22887 | 2/1990 | Japan | 401/213 |
| 5991 | 2/1990 | Japan | 401/213 |
| 5-058090 | 9/1993 | Japan | 401/213 |
| 270136 | 11/1950 | Switzerland | 401/213 |

*Primary Examiner*—Steven A. Bratlie

*Attorney, Agent, or Firm*—Frishauf, Holtz, Goodman, Langer & Chick

[57] ABSTRACT

An applicator in which the air within an inner barrel of a cap to the applicator is enabled to flow readily into the fluid tank of the applicator to increase the internal pressure of the fluid tank when the cap is engaged with the neck of the applicator, so that the fluid tank of the applicator need not be pressed between the fingers of a user for application of a highly viscous fluid. The inner barrel of the cap includes a curved, elastically deformable valve-opening member made of a highly flexible material bearing against the closed end of the cap. When the cap is engaged with the body of the applicator, the valve-opening member abuts against an application member to retract the application member from a caulked front edge of the tip of the applicator so as to form a clearance between the application member and the caulked front edge of the tip through which air can readily flow to increase the internal pressure of the fluid tank. When the cap is fully engaged with the neck of the applicator, the curved, elastically deformable valve-opening member deforms so as to close the clearance between the application member and the caulked front edge of the tip and to maintain the increased internal pressure of the fluid tank.

5 Claims, 3 Drawing Sheets

APPLICATOR HAVING CAP WHICH PRESSURIZES AND SEALS INNER SPACE

BACKGROUND OF THE INVENTION

This invention relates to an applicator for holding and applying a highly viscous fluid such as a correction fluid, a make-up fluid, an adhesive or a paint.

In an applicator having a spherical form of application member (application ball), a tip is attached to a neck formed at one end of a fluid tank which is filled with a fluid to be applied. The tip bears rotatably therein an application ball in such a way that the application ball may partly be exposed from the front edge thereof like a ball-point pen. The application ball is resiliently urged by a spring so as to bring the application ball into intimate contact with a caulked front edge of the tip, so as to allow the application ball and the front edge of the tip to form a valve structure for preventing the fluid to be applied from being discharged when the applicator is not used. When the application ball is pressed against a surface on which the fluid is to be applied, the application ball retracts against the resilience of the spring to provide a clearance between the application ball and the front edge of the tip, allowing the fluid to be deposited on a hidden portion of the application ball located within the tip for delivery through the clearance to the outside of the tip for application as the application ball is rolled. However, a fluid having a high viscosity cannot normally be fed fully to the surface of the application ball. Accordingly, the fluid tank is molded by blowing using a flexible material to be squeezable, and the fluid tank must be pressed between a user's fingers to increase the internal pressure of the fluid tank so as to allow the fluid to be more easily fed to the surface of the application ball with the aid of the thus increased pressure and be applied to the surface to be treated.

Meanwhile, in the case where the application member is rod-shaped, a tapered portion is formed at the middle of the application member. The tapered portion of the application member is resiliently urged by a spring to be brought into intimate contact with a caulked front edge of the tip to form a valve structure between the rod-shaped application member and a front edge of the tip, so that the fluid to be applied may not be discharged when the applicator is not in use. When the application member is pressed against the surface to be treated, the application member retracts against the resilience of the spring to provide a clearance between the tapered portion of the application member and the front edge of the tip. Again, the fluid tank must be pressed between a user's fingers so as to increase the internal pressure of the fluid tank in order to feed the fluid to the application member and apply the fluid to the surface to be treated.

As described above, the prior art applicators have the disadvantage that the handling thereof is more difficult since the fluid tank must be pressed between a user's fingers to increase the internal pressure of the tank for application of the fluid, and the further disadvantage that the production cost elevates since the fluid tank must be molded by blowing using a flexible material.

If a cap is designed to be able to be push-fitted to the neck of the fluid tank with the front edge of the tip being sealed with the inner barrel of the cap and to be able reduce the volume of the sealed space defined within the inner barrel, when the cap is engaged with the neck the internal pressure of the inner barrel can be increased. Accordingly, air in the inner barrel will flow into the fluid tank to increase the internal pressure of the fluid tank, and thus the fluid tank need not be pressed between a user's fingers for application of the fluid to be applied. However, since the application ball is resiliently urged by the spring, the application member must be retracted against the resilience of the spring so as to allow the air in the inner barrel to intrude into the fluid tank. Accordingly, the internal pressure of the inner barrel must be sufficiently increased. In other words, while the push fitting stroke of the cap in the state where the inner barrel thereof is sealing the front edge of the tip must be increased, the longer the inner barrel of the cap becomes, the more difficult the pressurizing operation becomes.

OBJECT AND SUMMARY OF THE INVENTION

Therefore, the present invention is directed to provide an applicator at a low production cost which allows easy flow of air within an inner barrel of the cap of the applicator into the fluid tank when the cap is engaged with the neck of the applicator, so as to increase the internal pressure of the fluid tank and thus require no pressing of the fluid tank between the fingers of a user for application.

In order to attain the intended objects, the applicator according to the present invention has an application member retained in a tip such that the application member may partly be exposed from the front end opening of the tip, a spring for resiliently urging the application member to be abutted against a caulked front edge of the tip, a fluid tank in which a highly viscous film-forming fluid to be applied is contained and a neck formed contiguous to said fluid tank in which the tip is held, the outer circumference of the neck being in intimate contact with the inner circumference of the inner barrel of the cap so as to seal the tip. A spherical, elastically deformable valve-opening member made of a highly flexible material is included in the inner barrel of the cap and the application member is designed to retract from the caulked front edge of the tip of the applicator when the application member is abutted against the tip of the valve-opening member during engagement of the cap with the neck. Moreover, the spherical, elastically deformed valve-opening member is designed to close the front end opening of the tip when the cap is fully engaged with the neck of the applicator.

More specifically, since the application member is abutted against the tip of the valve-opening member when the cap is engaged with the neck, the application ball is repulsively retracted to be spaced from the caulked front edge of the tip to open the valve mechanism. Accordingly, pressurized air in the inner barrel readily flows into the fluid tank to increase the internal pressure of the fluid tank. Since the valve-opening member undergoes a considerable elastic deformation to close the front end opening of the tip after the cap is fully engaged with the neck, the increased internal pressure of the fluid tank can be maintained, so that the fluid tank need not be pressed between the fingers of a user for application of the fluid contained therein. In addition, the fluid tank need not be molded by blowing using a flexible material but can be injection molded using an ordinary rigid synthetic resin, so that the applicator can be produced more inexpensively.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF PREFERRED EMBODIMENTS

Figure 1:
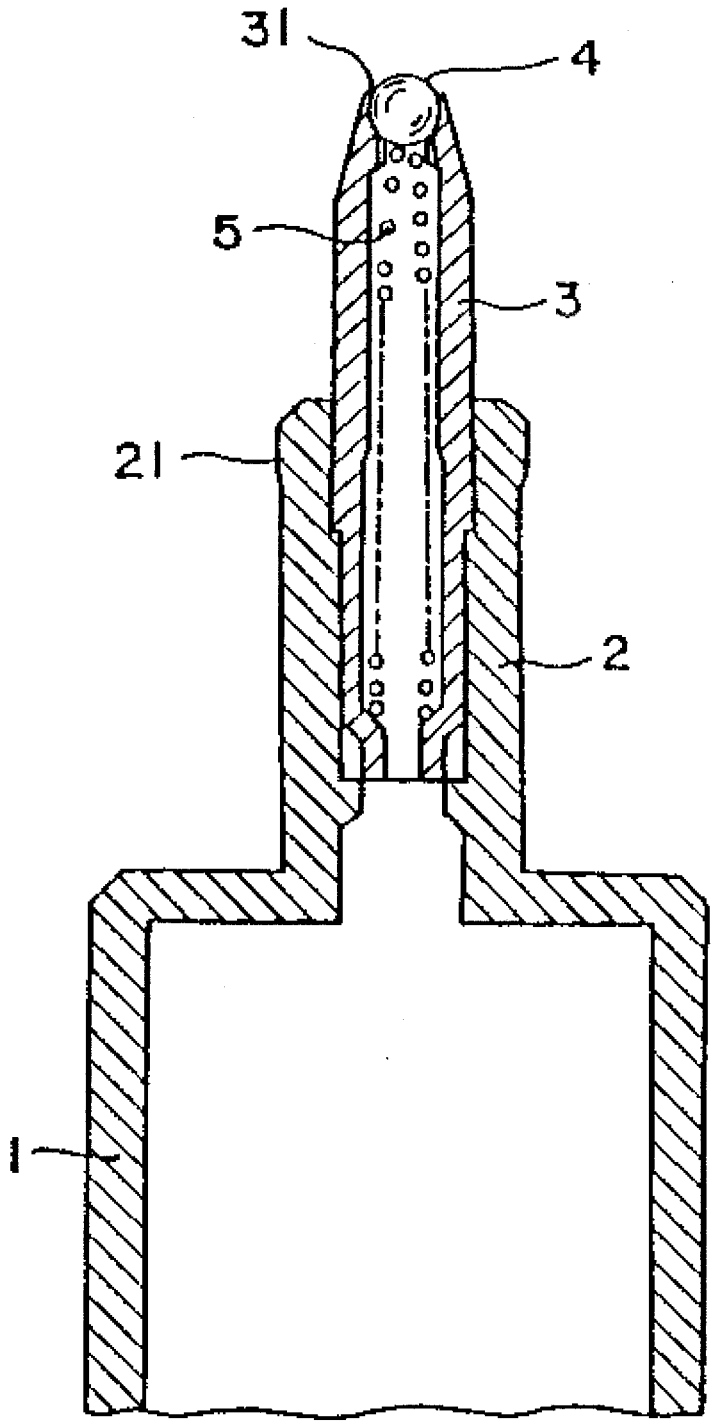
FIG. 1 shows a cross-sectional view of an applicator.

The present invention will now be described below specifically based on the embodiments shown in the attached drawings. In FIG. 1, a tip 3 is fitted in the front end opening of a neck 2 having an annular ridge 21 formed along the front end portion thereof. The tip 3 is made of stainless steel and has a bullet-like form. A ball housing is defined in the front end portion of the tip 3, which bears rotatably therein an application ball 4, preferably comprising a 1.0 mm diameter hard ball, in such a way that the application ball 4 may partly be exposed from the front edge of the tip 3. The tip 3 may be of a metallic pipe.

A small spring 5, preferably having a spring power of 40 g, is disposed in the tip 3 and resiliently urges the application ball 4 to be in pressed contact with the caulked front edge 31 of the tip 3 to constitute a valve mechanism between the application ball 4 and the front edge 31 of the tip 3. The neck 2 is formed integrally with a fluid tank 1. The fluid tank 1 can be injection molded using an ordinary rigid synthetic resin which can be produced at a low production cost compared with those molded by blowing using flexible materials. A fluid to be applied, for example, a correction fluid having a high film-forming property with a viscosity of 30 to 40 cps can be filled in the fluid tank 1 throughout cavities in the neck 2 and the tip 3.

Figure 2:
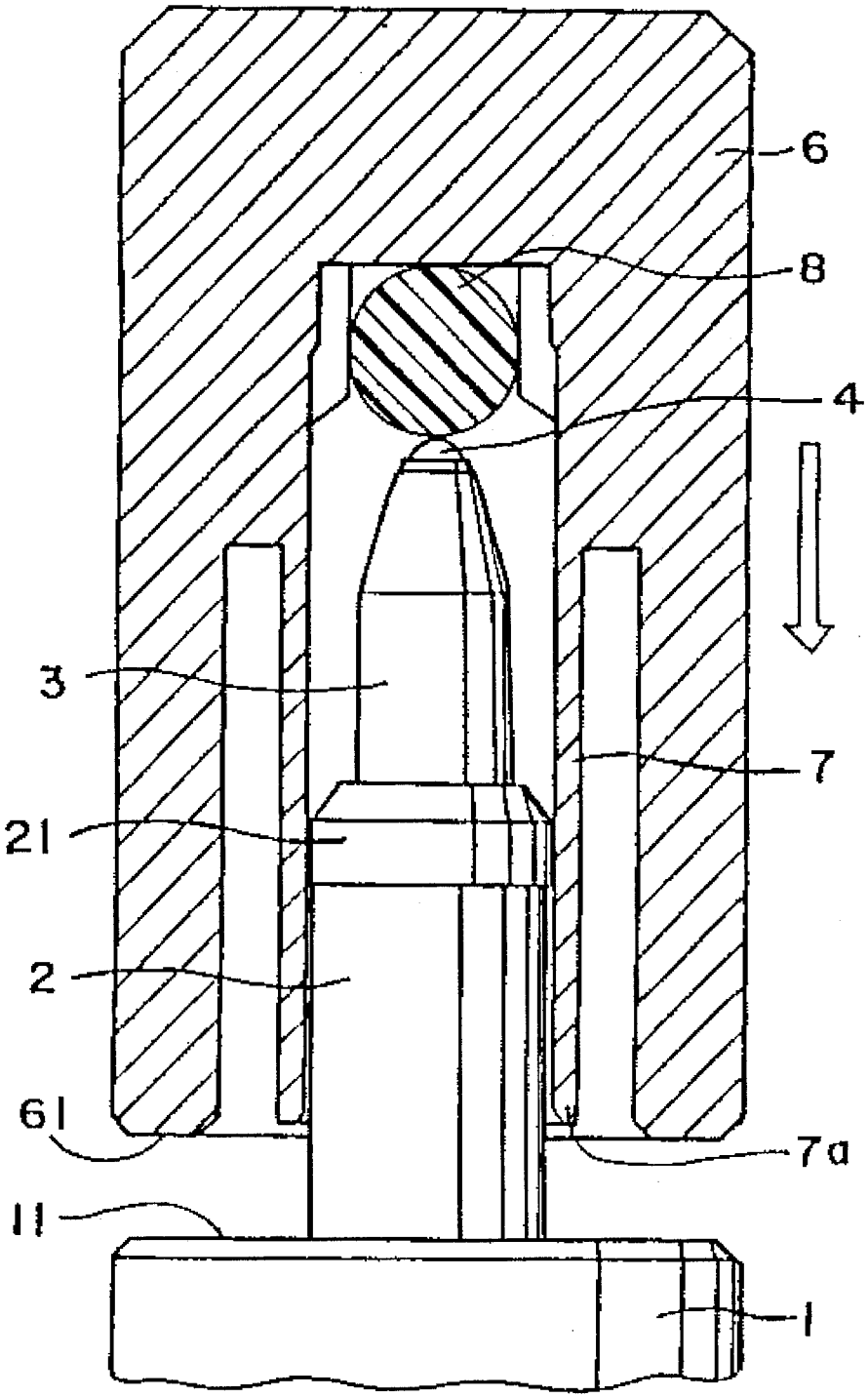
FIG. 2 shows an explanatory view of a cap being engaged with the applicator.

A cap 6, which can also be molded using a synthetic resin, has an inner barrel 7 formed integrally therein, as shown in FIG. 2. A hermetically sealed space is defined in the inner barrel 7 by bringing the inner circumference at the front edge 7*a* of the inner barrel 7 into intimate contact with the annular ridge 21 of the neck 2. The inner barrel 7 has a spherical, elastically deformable valve-opening member 8 molded using a highly flexible material disposed therein.

Thus, the front edge 7*a* of the inner barrel 7 is brought into intimate contact with the annular ridge 21 of the neck 2 when the cap 6 is engaged with the neck 2 to provide a hermetically sealed space within the inner barrel 7. By pushing the cap 6 further in the direction shown by the arrow in FIG. 2, the inner circumference of the inner barrel 7 slides against and along the annular ridge 21 to reduce the volume of the sealed space in the inner barrel 7, and thus the air within the inner barrel 7 is pressurized. When the application ball 4 is thus abutted against the tip of the valve-opening member 8, as shown in FIG. 2, the application ball 4 is forced to retract by the repulsion of the valve-opening member 8 if the cap is pushed further. Namely, a clearance is provided between the application ball 4 and the front edge 31 of the tip 3 to allow the air within the inner barrel 7 to intrude into the fluid tank 1 and thus increase the internal pressure of the fluid tank 1.

Figure 3:
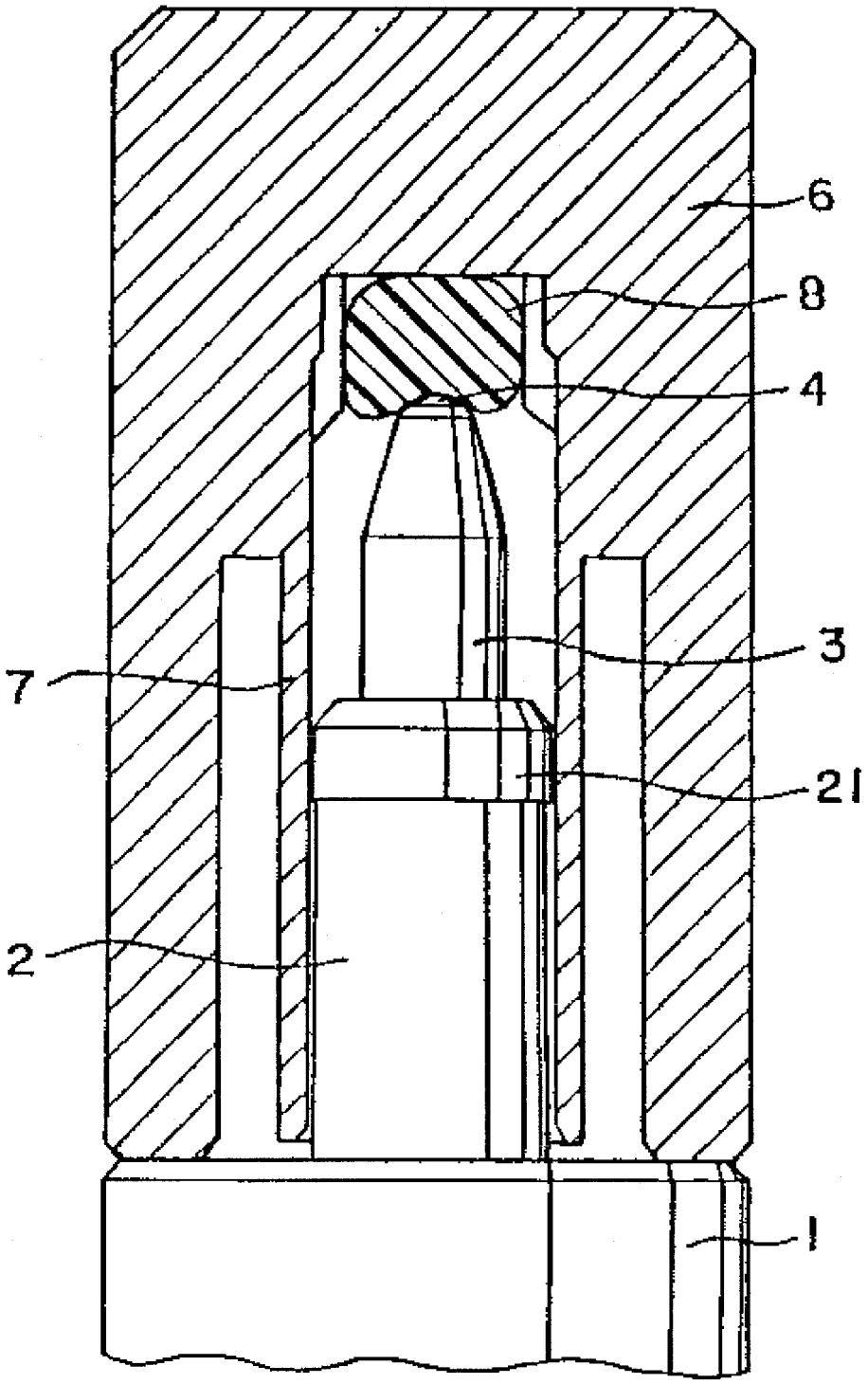
FIG. 3 shows an explanatory view of the cap fully engaged with the applicator.

When the cap 6 assuming the state shown in FIG. 2 is further pushed to allow the abutment 61 of the cap 6 to abut against the step 11 of the fluid tank 1, the cap 6 is fully engaged with the neck 2, as shown in FIG. 3. In this state, the spherical valve-opening member 8, which is molded using a highly flexible material, undergoes a considerable elastic deformation to close the front end opening of the tip 3, and thus the increased pressure in the fluid tank 1 can be maintained.

When the cap 6 is fully engaged as described above, air within the inner barrel 7 is allowed to readily flow into the fluid tank 1 and increase the internal pressure of the fluid tank 1, without increasing the internal pressure of the inner barrel 7. Accordingly, when the highly viscous fluid contained in the fluid tank 1 is to be applied after removal of the cap 6, the fluid can fully be fed to the application ball 4. Namely, the fluid tank 1 need not be pressed between a user's fingers, and the highly viscous fluid can be easily applied to the surface to be treated in the same manner as writing with a ball-point pen.

Since the valve-opening member 8 has a spherical form, it can easily be incorporated into the cap 6 without considering the orientation thereof, and further it can easily absorb dimensional errors. In addition, because of its spherical structure, the valve-opening member 8 has a relief clearance which allows the member 8 not to readily undergo plastic deformation.

In the embodiments described above, the application members have spherical forms. However, the application members may also be of a rod-like shape having a tapered portion at the middle.

As has been described hereinabove, in the applicator according to the present invention, the application member is designed to be abutted against the tip of an elastically deformable valve-opening member when the cap is engaged with the neck so that the application member is retracted repulsively and spaced from the caulked front edge of the tip to open a clearance through which air pressurized within the inner barrel of the cap can readily flow into the fluid tank to increase the internal pressure of the fluid tank. Moreover, the front end opening of the tip is designed to be closed by the elastically deformed valve-opening member when the cap is fully engaged so as to maintain the increased internal pressure of the fluid tank. Accordingly, the fluid tank need not be pressed between a user's fingers for application of the fluid contained therein, and the fluid tank need not be molded by blowing using a flexible material but rather can be injection molded using an ordinary rigid synthetic resin so that the applicator can be produced more inexpensively.

It should be apparent to those skilled in the art that the present invention may be embodied in many other specific forms without departing from the spirit or scope of the invention.

What is claimed is:

1. An applicator comprising:

a fluid tank for holding a highly viscous film-forming fluid to be applied;

a neck coupled to said fluid tank, said neck having a tip at a front end portion thereof;

an application member retained in a front end portion of said tip such that said application member is partly exposed for applying said highly viscous film-forming fluid to a surface;

a spring in said neck, said spring being arranged to resiliently urge said application member to abut against a caulked front edge of said tip;

a cap for engaging said neck, said cap having a closed end, an open end and an inner barrel which has an inner circumference which intimately contacts an outer circumference of said neck so as to seal against said neck to increase air pressure inside said inner barrel when said cap is engaged on said neck; and a curved, elastically deformable valve-opening member bearing against said closed end of said cap, said curved, elastically deformable valve opening member being arranged to abut against said application member when said cap is being engaged with said neck so as to retract said application member from the caulked front edge of said tip, against the urging force of said spring, to form a clearance between said application member and said caulked front edge of said tip through which pressurized air in said inner barrel of said cap flows from said inner barrel to an interior of said fluid tank to increase the internal pressure of said fluid tank, and said curved, elastically deformable valve opening member being further arranged to deform when said cap is fully engaged with said neck so as to close said clearance between said application member and said caulked front edge of said tip and to maintain the increased internal pressure of said fluid tank.

2. The applicator according to claim 1, wherein said curved, elastically deformable valve opening member comprises a highly flexible material.

3. The applicator according to claim 1, wherein said curved, elastically deformable valve opening member is spherical in shape.

4. The applicator according to claim 1, wherein said application member is a ball rotatably retained in said tip.

5. The applicator according to claim 1, wherein said curved, elastically deformable valve opening member is arranged in said cap to contact said closed end of said cap.

* * * * *